US006557350B2

(12) United States Patent
Farmer et al.

(10) Patent No.: US 6,557,350 B2
(45) Date of Patent: May 6, 2003

(54) METHOD AND APPARATUS FOR COOLING GAS TURBINE ENGINE IGNITER TUBES

(75) Inventors: Gilbert Farmer, Cincinnati, OH (US); Ella Christine Kutter, Miamisburg, OH (US); Steven Clayton Vise, Cincinnati, OH (US); John Robert Staker, Cincinnati, OH (US); Marwan Al-Roub, Cincinnati, OH (US); Tariq Kay Harris, Cincinnati, OH (US)

(73) Assignee: General Electric Company, Schenectady, NY (US)

( * ) Notice: Subject to any disclaimer, the term of this patent is extended or adjusted under 35 U.S.C. 154(b) by 49 days.

(21) Appl. No.: 09/859,611

(22) Filed: May 17, 2001

(65) Prior Publication Data

US 2002/0170293 A1 Nov. 21, 2002

(51) Int. Cl.[7] ..... F02C 7/22; F02C 7/26
(52) U.S. Cl. ..... 60/776; 60/39.821
(58) Field of Search ..... 60/39.821, 39.83, 60/752, 755–760, 776

(56) References Cited

U.S. PATENT DOCUMENTS 2,422,213 A * 6/1947 Smith ..... 431/352
4,194,358 A 3/1980 Stenger
4,628,694 A * 12/1986 Kelm et al. ..... 60/752
4,875,339 A * 10/1989 Rasmussen et al. ..... 60/757
5,088,287 A 2/1992 Shekleton
5,129,231 A * 7/1992 Becker et al. ..... 60/754
5,402,637 A 4/1995 Adam
5,442,907 A * 8/1995 Asquith et al. ..... 60/39.091
6,212,870 B1 4/2001 Thompson et al.
6,438,958 B1 * 8/2002 McCaffrey et al. ..... 60/752

* cited by examiner

*Primary Examiner*—Charles G. Freay
*Assistant Examiner*—William H. Rodriguez
(74) *Attorney, Agent, or Firm*—William Scott Andes; Armstrong Teasdale LLP; Robert B. Reeser, III

(57) ABSTRACT

A combustor for a gas turbine engine includes a plurality of igniter tubes that facilitate reducing temperature gradients within the combustor in a cost effective and reliable manner. The combustor includes an annular outer liner that includes a plurality of openings sized to receive igniter tubes. Each igniter tube maintains an alignment of each igniter received therein, and includes an air impingement device that extends radially outward from the igniter tube. During operation, airflow contacting the air impingement device is channeled radially inward for impingement cooling of the igniter tubes and the combustor outer liner.

19 Claims, 4 Drawing Sheets

METHOD AND APPARATUS FOR COOLING GAS TURBINE ENGINE IGNITER TUBES

BACKGROUND OF THE INVENTION

This invention relates generally to gas turbine engines, and more specifically to igniter tubes used with gas turbine engine combustors.

Combustors are used to ignite fuel and air mixtures in gas turbine engines. Known combustors include at least one dome attached to a combustor liner that defines a combustion zone. More specifically, the combustor liner includes an inner and an outer liner that extend from the dome to a turbine nozzle. The liner is spaced radially inwardly from a combustor casing such that an inner and an outer passageway are defined between the respective inner and outer liner and the combustor casing.

Fuel igniters extend through igniter tubes attached to the combustor outer liner. More specifically, the fuel igniter tubes extend through the outer passageway and maintain the igniters in alignment relative to the combustion chamber.

During operation, high pressure airflow is discharged from the compressor into the combustor where the airflow is mixed with fuel and ignited with the igniters. A portion of the airflow entering the combustor is channeled through the combustor outer passageway for cooling the outer liner, the igniters, and diluting a main combustion zone within the combustion chamber. Because the igniters are bluff bodies, the airflow may separate and wakes may develop downstream from each igniter. As a result of the wakes, a downstream side of the igniters and igniter tubes is not as effectively cooled as an upstream side of the igniters and igniter tubes which is cooled with airflow that has not separated. Furthermore, as a result of the wakes, circumferential temperature gradients may develop in the igniter tubes. Over time, continued operation with the temperature gradients may induce potentially damaging thermal stresses into the combustor that exceed an ultimate strength of materials used in fabricating the igniter tubes. As a result, thermally induced transient and steady state stresses may cause low cycle fatigue (LCF) failure of the igniter tubes.

Because igniter tube replacement is a costly and time-consuming process, at least some known combustors increase a gap between the igniters and the igniter tubes to facilitate reducing thermal circumferential stresses induced within the igniter tubes. As a result of the gap, leakage passes from the passageways to the combustion chamber to provide a cooling effect for the igniter tubes adjacent the combustor liner. However, because such air is used in the combustion process, such gaps provide only intermittent cooling, and the igniter tubes may still require replacement.

BRIEF SUMMARY OF THE INVENTION

In an exemplary embodiment, a combustor for a gas turbine engine includes a plurality of igniter tubes that facilitate reducing wake temperatures and temperature gradients within the combustor in a cost effective and reliable manner. The combustor includes an annular outer liner that includes a plurality of openings sized to receive igniter tubes. Each igniter tube maintains an alignment of each igniter received therein, and includes an air impingement device that extends radially outward from the igniter tube.

During operation, airflow contacting the air impingement device is channeled radially inward towards an aft end of the igniter tubes and towards the combustor outer liner. More specifically, the airflow is directed circumferentially around the igniter tubes for impingement cooling the igniter tube and the surrounding combustor outer liner. The impingement cooling facilitates reducing overall wake temperatures and circumferential temperature gradients in the igniter tubes and the combustor outer liner. As a result, lower thermal stresses and therefore improved low cycle fatigue life of the igniter tubes are facilitated in a cost-effective and reliable manner.

DETAILED DESCRIPTION OF THE INVENTION

Figure 1:
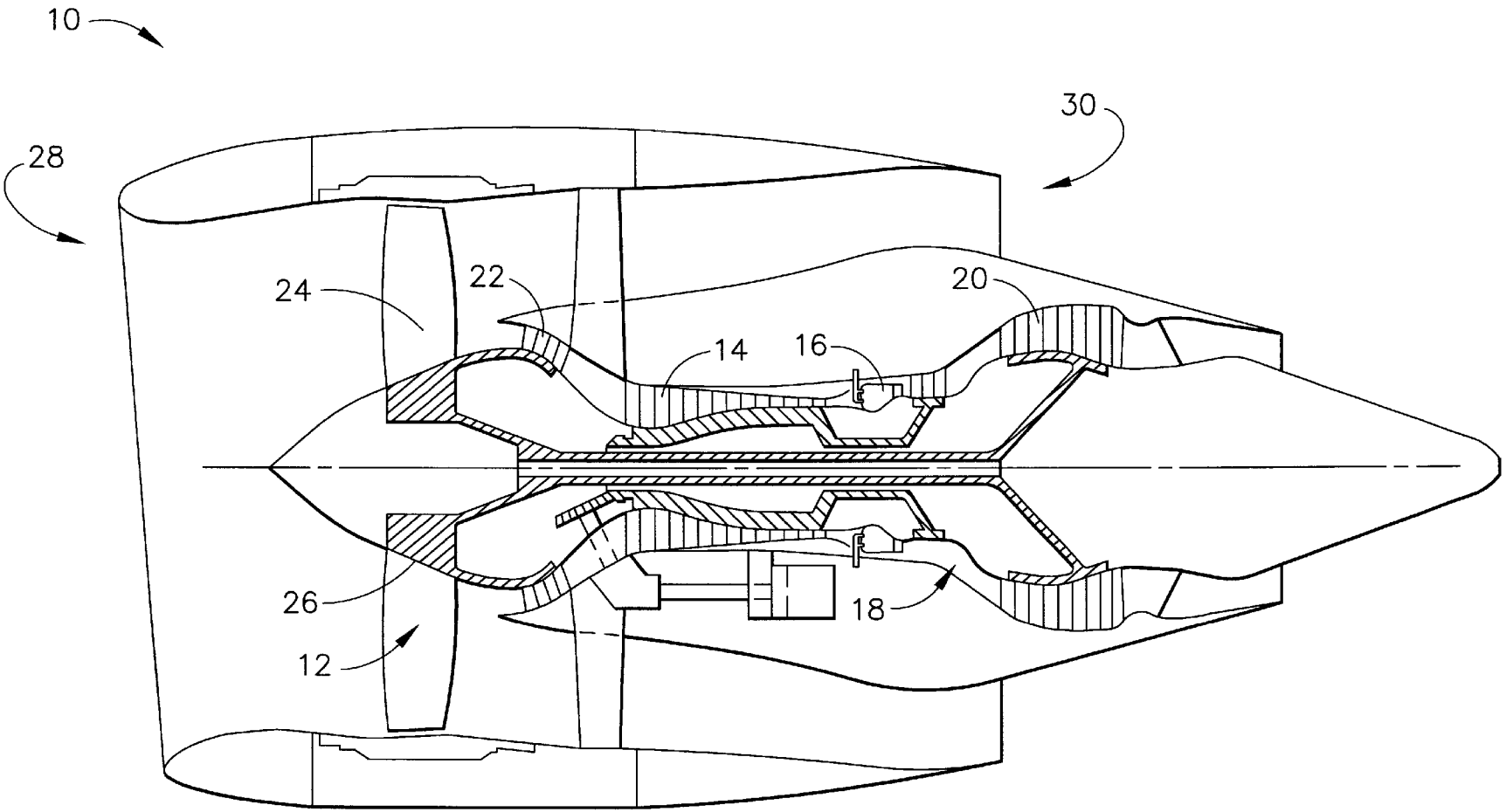
FIG. 1 is a schematic illustration of a gas turbine engine including a combustor.

FIG. 1 is a schematic illustration of a gas turbine engine 10 including a fan assembly 12, a high pressure compressor 14, and a combustor 16. Engine 10 also includes a high pressure turbine 18, a low pressure turbine 20, and a booster 22. Fan assembly 12 includes an array of fan blades 24 extending radially outward from a rotor disc 26. Engine 10 has an intake side 28 and an exhaust side 30. In one embodiment, gas turbine engine 10 is a GE90 engine commercially available from General Electric Company, Cincinnati, Ohio.

In operation, air flows through fan assembly 12 and compressed air is supplied to high pressure compressor 14. The highly compressed air is delivered to combustor 16. Airflow from combustor 16 drives turbines 18 and 20, and turbine 20 drives fan assembly 12.

Figure 2:
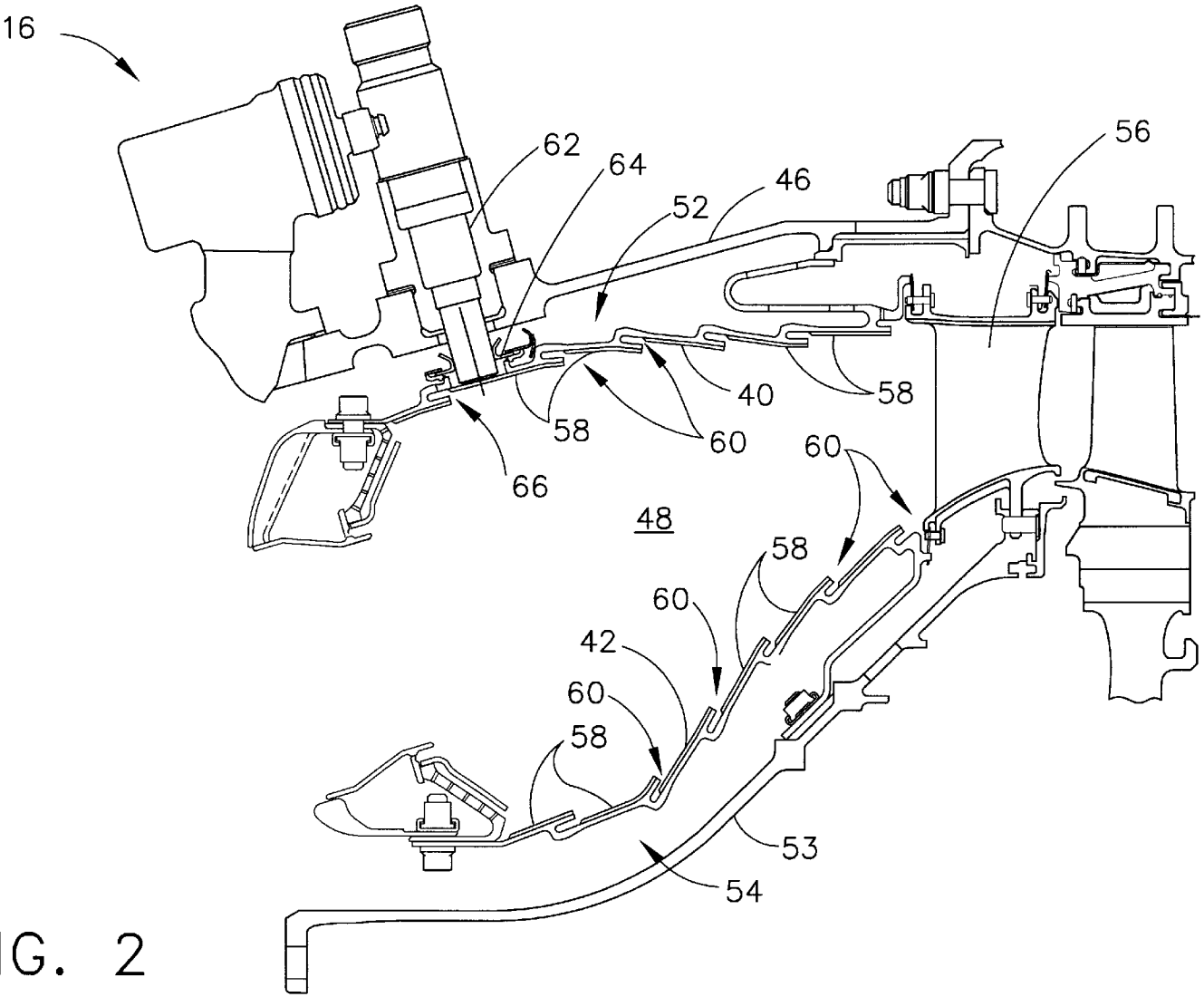
FIG. 2 is a cross-sectional view of a combustor that may be used with the gas turbine engine shown in FIG. 1.

FIG. 2 is a cross-sectional view of combustor 16 used in gas turbine engine 10. Combustor 16 includes an annular outer liner 40, an annular inner liner 42, and a domed end (not shown) that extends between outer and inner liners 40 and 42, respectively. Outer liner 40 and inner liner 42 are spaced inward from a combustor casing 46 and define a combustion chamber 48. Outer liner 40 and combustor casing 46 define an outer passageway 52, and inner liner 42 and a forward inner nozzle support 53 define an inner passageway 54.

Combustion chamber 48 is generally annular in shape and is disposed between liners 40 and 42. Outer and inner liners 40 and 42 extend from the domed end, to a turbine nozzle 56 disposed downstream from the combustor domed end. In the exemplary embodiment, outer and inner liners 40 and 42 each include a plurality of panels 58 which include a series of steps 60, each of which forms a distinct portion of combustor liners 40 and 42.

A plurality of fuel igniters 62 extend through combustor casing 46 and outer passageway 52, and couple to combustor outer liner 40. In one embodiment, two fuel igniters 62 extend through combustor casing 46. Igniters 62 are bluff bodies that are placed circumferentially around combustor 16 and are downstream from the combustor domed end. Each igniter 62 is positioned to ignite a fuel/air mixture within combustion chamber 48, and each includes an igniter tube 64 coupled to combustor outer liner 40. More specifically, each igniter tube 64 is coupled within an opening 66 extending through combustor outer liner 40, such that each igniter tube 64 is concentrically aligned with respect to each opening 66. Igniter tubes 64 maintain alignment of each igniter relative to combustor 16. In one embodiment, combustor outer liner opening 66 has a substantially circular cross-sectional profile.

During engine operation, airflow (not shown) exits high pressure compressor 14 (shown in FIG. 1) at a relatively high velocity and is directed into combustor 16 where the airflow is mixed with fuel and the fuel/air mixture is ignited for combustion with igniters 62. As the airflow enters combustor 16, a portion (not shown in FIG. 2) of the airflow is channeled through combustor outer passageway 52. Because each igniter 62 is a bluff body, as the airflow contacts igniters 62, a wake develops in the airflow downstream each igniter 62.

Figure 3:
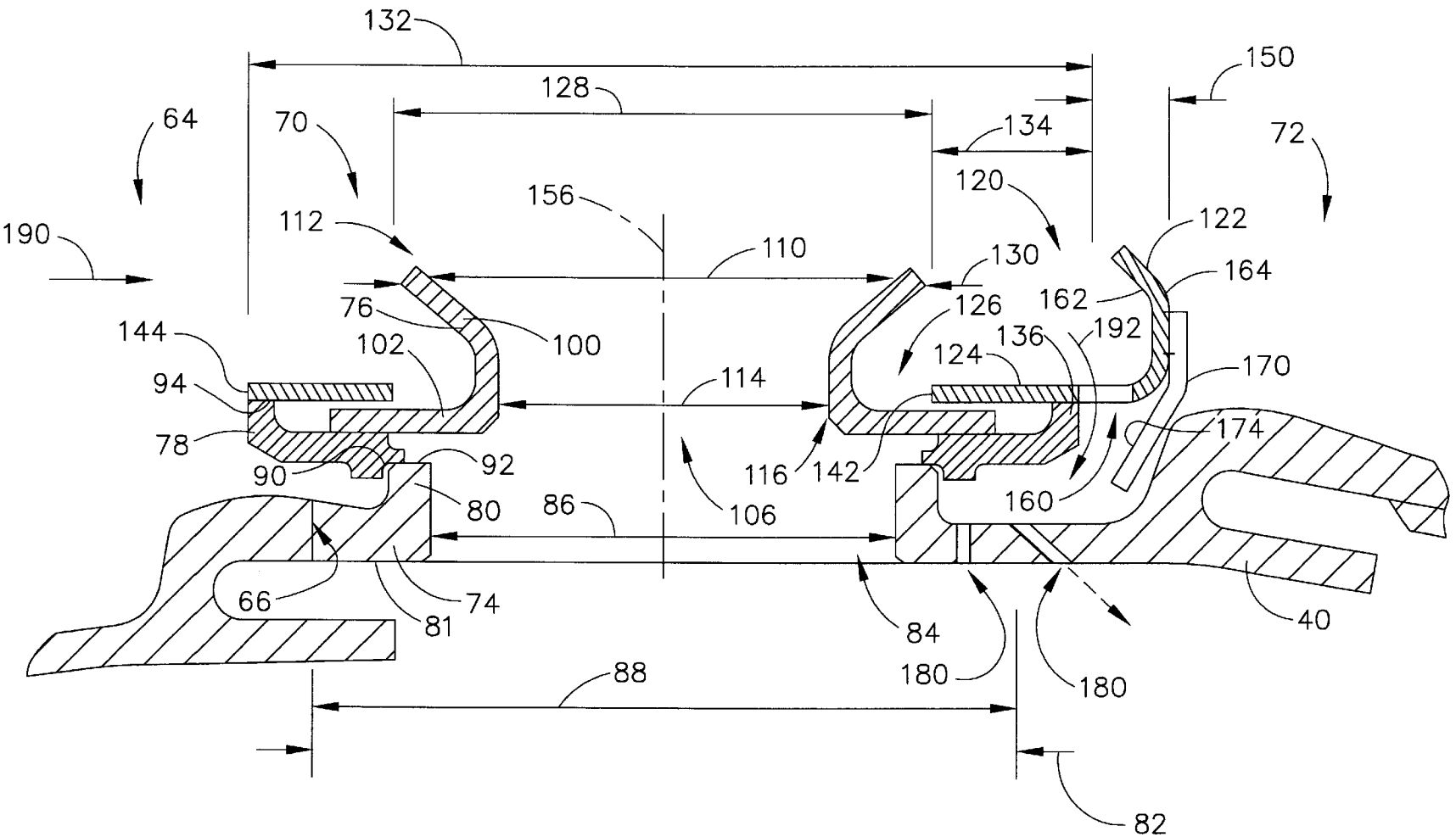
FIG. 3 is an enlarged cross-sectional view of a portion of the combustor shown in FIG. 2.
Figure 4:
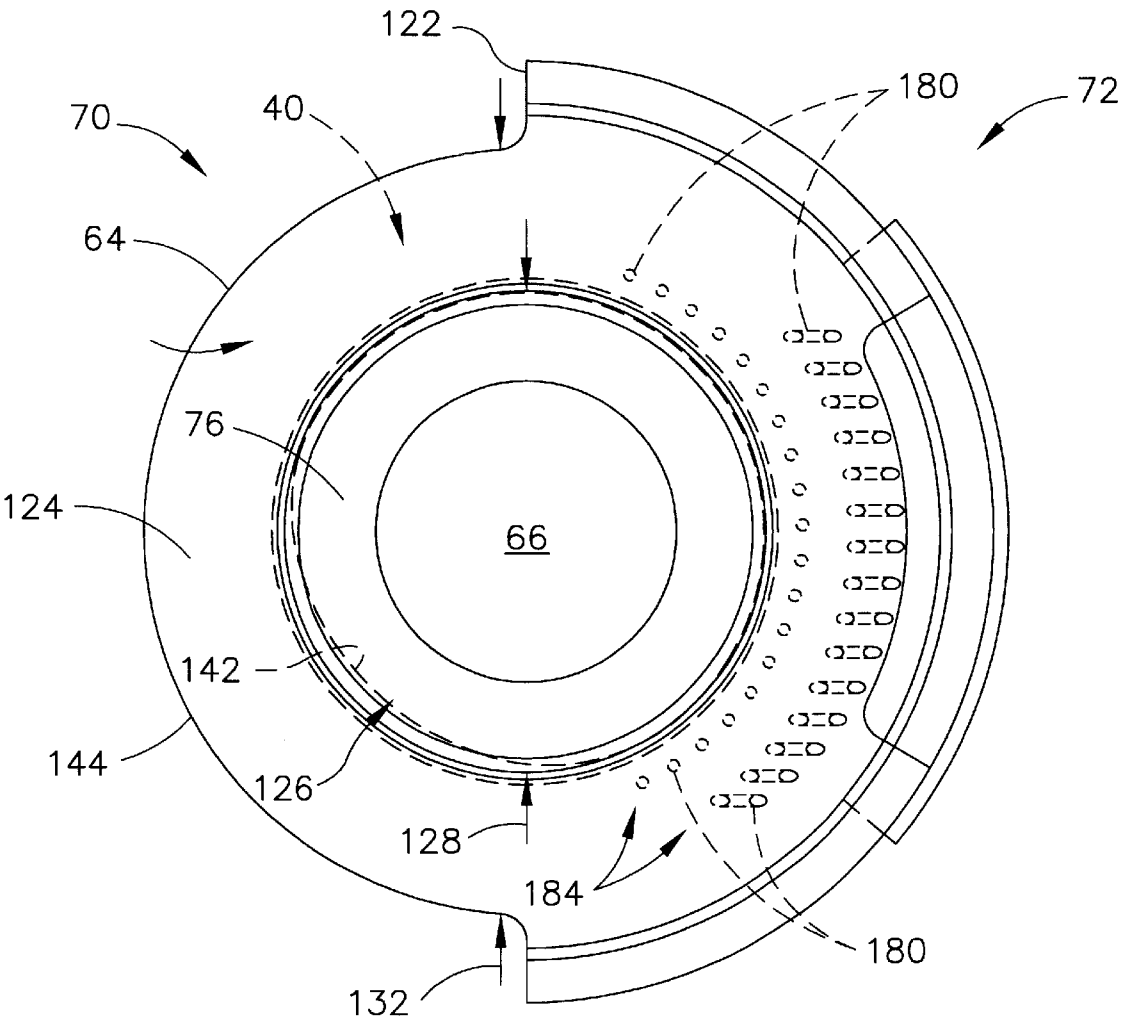
FIG. 4 is a plan view of the portion of the combustor shown in FIG. 3.

FIG. 3 is an enlarged cross-sectional view of igniter tube 64 coupled to combustor outer liner 40. FIG. 4 is a plan view of igniter tube 64 coupled to combustor outer liner 40. Igniter tube 64 has an upstream side 70, and a downstream side 72. Igniter tube 64 also has a radially inner flange portion 74, a radially outer portion 76, and a supporting ring 78 extending therebetween.

Radially inner flange portion 74 is annular and includes a projection 80 that extends radially outwardly from flange portion 74 towards supporting ring 78. More specifically, flange portion 74 extends between an igniter tube inner surface 81 and supporting ring 78, and has an outer diameter 82. Flange portion 74 also includes an opening 84 extending therethrough with a diameter 86. In one embodiment, opening 84 is substantially circular. Flange portion opening 84 is sized to receive igniters 62. Flange portion outer diameter 82 is approximately equal to an inner diameter 88 of combustor outer liner opening 66, and accordingly, igniter tube flange portion 74 is received in close tolerance within combustor outer liner opening 66. In the exemplary embodiment, igniter tube radially inner flange portion 74 has a substantially circular outer perimeter.

Igniter tube supporting ring 78 includes a recess 90 sized to receive a portion of radially inner flange portion projection 80 therein. More specifically, supporting ring 78 is attached to a radially outer surface 92 of flange portion projection 80, such that supporting ring 78 extends radially outwardly and substantially perpendicularly from flange portion 74. Igniter tube supporting ring 78 also includes a projection 94 that extends substantially perpendicularly from supporting ring 78 towards igniter tube radially outer portion 76.

Igniter tube radially outer portion 76 is attached to supporting ring 78 and includes a receiving ring 100 and an attaching ring 102. Attaching ring 102 is annular and extends from supporting ring 78 such that attaching ring 102 is substantially parallel to supporting ring 78. Receiving ring 100 extends radially outwardly from attaching ring 102. More specifically, receiving ring 100 extends divergently from attaching ring 102, such that an opening 106 extending through igniter tube radially outer portion 76 has a diameter 110 at an entrance 112 of radially outer portion 76 that is larger than a diameter 114 at an exit 116 of radially outer portion 76. Accordingly, radially outer portion entrance 112 guides igniters 62 into igniter tube 64, and radially outer portion exit 114 maintains igniters 62 in alignment relative to combustor 16 (shown in FIGS. 1 and 2).

Igniter tube 64 also includes an air impingement device 120 that extends radially outwardly from igniter tube 64. Air impingement device 120 includes a scoop or deflector portion 122 and a ring flange portion 124. Ring flange portion 124 has an opening 126 extending therethrough and concentrically aligned with respect to flange portion opening 84. More specifically, ring flange portion 124 has an inner diameter 128 that is larger than maximum outer diameter 130 of igniter tube radially outer portion receiving ring 100. Ring flange portion 124 also has an outer diameter 132.

Air impingement device ring flange portion 124 is attached to igniter tube supporting ring 78 and igniter tube radially outer portion 76. Ring flange portion 124 has a width 134 measured between inner and outer edges 142 and 144, respectively, of ring flange portion 124.

Air impingement scoop portion 122 extends from ring flange portion outer edge 144. Specifically, scoop portion 122 extends radially outward from ring flange portion outer edge 144 about approximately half of a total perimeter of ring flange portion 124. Scoop portion 122 extends a distance 150 radially outward from ring flange outer edge 144 about igniter tube downstream side 72.

Scoop portion 122 is curved towards a centerline axis of symmetry 156 of igniter tube 64. More specifically, scoop portion 122 is aerodynamically contoured to channel airflow striking scoop portion 122 radially inward towards combustor outer liner 40. Scoop portion 122 also includes an opening 160 that extends from a radially outer surface 162 of scoop portion 122 to a radially inner surface 164 of scoop portion 122. Accordingly, airflow striking scoop portion 122 is directed radially inward through scoop portion opening 160. Opening 160 is known as a directed air hole. In one embodiment, opening 160 extends within scoop portion 122.

An air director 170 is attached to scoop portion radially inner surface 164 and extends towards combustor outer liner 40. More specifically, air director 170 is attached to a downstream side 72 of scoop portion 122 and is contoured such that a radially inner side 174 of air director 170 extends radially inwardly towards igniter tube centerline axis of symmetry 156, but does not contact igniter tube 64 or combustor outer liner 40. Accordingly, air director 170 is in flow communication with scoop portion opening 160.

Combustor outer liner 40 includes a plurality of cooling openings 180 that extend through combustor outer liner 40. More specifically, cooling openings 180 are radially outward from combustor outer liner igniter opening 66 and extend around a downstream side 72 of combustor outer liner opening 66. In the exemplary embodiment, cooling openings 180 are arranged in a plurality of arcuate rows 184. Cooling openings 180 are in flow communication with combustion chamber 48. Scoop portion 122 is radially outward from cooling openings 180, such that scoop portion opening 160 is in flow communication with cooling openings 180.

During engine operation, airflow exits high pressure compressor 14 (shown in FIG. 1) at a relatively high velocity and is directed into combustor 16 where the airflow is mixed with fuel and the mixture is ignited for combustion with igniters 62 (shown in FIG. 2). As the airflow enters combustor 16, a portion 190 of the airflow is channeled through combustor outer passageway 52 (shown in FIG. 2). A portion 192 of combustor outer passageway airflow 190 directed radially inward after contacting air impingement device 120. More specifically, as airflow portion 190 strikes air impingement device scoop 122, airflow portion 192 is channeled radially inward along scoop portion 122 and through scoop directed air hole 160.

As airflow is discharged from scoop portion 122, the airflow contacts air director 170, and is redirected. Air director 170 channels airflow portion 190 towards igniter tube centerline axis of symmetry 156 and into combustor outer liner cooling openings 180. Furthermore, scoop portion 122 directs the airflow circumferentially around igniter tube radially inner flange portion 74 for impingement cooling of igniter tube 64 and combustor outer liner 40. As a result, local convective heat transfer is facilitated to be enhanced, thereby decreasing circumferential temperature gradients around igniter tubes 64, and between igniter tubes 64 and combustor outer liner 40. Decreased wake temperatures and circumferential temperature gradients facilitate lower thermal stresses are induced into igniter tubes 64 and therefore improved low cycle fatigue (LCF) life of igniter tubes 64.

The above-described igniter tube is cost-effective and highly reliable. The igniter tubes include an air impingement device that channels airflow radially inwardly and circumferentially for impingement cooling of the igniter tubes and the combustor outer liner. More specifically, the air impingement device facilitates reducing wake temperatures and circumferential temperature gradients between igniter tubes and the combustor outer liner. As a result, lower thermal stresses and improved life of the igniter tubes are facilitated in a cost-effective and reliable manner.

While the invention has been described in terms of various specific embodiments, those skilled in the art will recognize that the invention can be practiced with modification within the spirit and scope of the claims.

What is claimed is:

1. A method for operating a gas turbine engine including a combustor, and a compressor, the combustor including a plurality of igniter tubes, and an outer liner and an inner liner that define a combustion chamber, the outer liner including a plurality of first openings sized to receive the igniter tubes therein, said method comprising the steps of:

operating the engine such that airflow is directed from the compressor to the combustor; and channeling a portion of the airflow for impingement cooling of the combustor outer liner using a plurality of deflectors, wherein each igniter tube includes at least one deflector extending radially outward from the igniter tube.

2. A method in accordance with claim 1 wherein each said at least one igniter tube deflector includes a director, an opening, and a scoop extending therebetween, said step of channeling a portion of the airflow further comprises the step of directing airflow radially inward through the deflector opening with the deflector scoop.

3. A method in accordance with claim 1 wherein the combustor outer liner further includes a plurality of second openings, said step of channeling a portion of the airflow further comprises the step of using the at least one igniter tube deflector to direct airflow into the plurality of second openings.

4. A method in accordance with claim 3 wherein each igniter tube deflector includes a director, an opening, and a scoop extending therebetween, said step of using the at least one igniter tube deflector further comprises the step of directing airflow through the at least one deflector opening into the plurality of combustor outer liner second openings.

5. A method in accordance with claim 1 wherein each igniter tube deflector extends downstream from a respective combustor outer liner first opening, said step of channeling a portion of the airflow further comprises the step of directing airflow that is downstream from combustor outer liner first openings towards the combustor outer liner.

6. A combustor for a gas turbine engine, said combustor comprising:

at least one igniter tube comprising a deflector extending radially outward from said igniter tube;

an annular inner combustor liner; and an annular outer combustor liner, said outer and inner combustor liners defining a combustion chamber, said outer combustor liner comprising a plurality of first openings and a plurality of second openings, each said first opening sized to receive each said igniter tube therein, each said second opening located downstream from each said first opening, each said igniter tube deflector contoured to deflect airflow through said plurality of second openings.

7. A combustor in accordance with claim 6 wherein said plurality of second openings extend radially outward from each said plurality of outer combustor liner first openings.

8. A combustor in accordance with claim 6 wherein each said igniter tube deflector extends downstream from each said outer combustor liner first opening.

9. A combustor in accordance with claim 8 wherein said plurality of second openings are located between each said igniter tube deflector and each said outer combustor liner first opening.

10. A combustor in accordance with claim 6 wherein each said igniter tube deflector comprises a director, an opening, and a scoop extending therebetween.

11. A combustor in accordance with claim 6 wherein each igniter tube deflector is in flow communication with said plurality of second openings.

12. A combustor in accordance with claim 6 wherein said plurality of deflectors configured to direct air for impingement cooling of said outer combustor liner.

13. A gas turbine engine comprising a combustor comprising a plurality of igniter tubes, an annular outer liner, and an annular inner liner, said outer and inner liners defining a combustion chamber, said outer liner comprising a plurality of openings sized to receive each said igniter tube therein, each said igniter tube comprising a deflector extending radially outward from said igniter tube and configured to deflect airflow for impingement cooling of said outer liner.

14. A gas turbine engine in accordance with claim 13 wherein each said igniter tube deflector contoured and comprising a director, an opening, and a scoop extending therebetween.

15. A gas turbine engine in accordance with claim 14 wherein said combustor outer liner further comprises a plurality of second openings, each said second opening downstream from each said first opening.

16. A gas turbine engine in accordance with claim 15 wherein each said igniter tube deflector is configured to direct airflow through said combustor outer liner plurality of second openings.

17. A gas turbine engine in accordance with claim 15 wherein each said igniter tube deflector extends downstream from each said combustor outer liner first opening beyond said combustor outer liner plurality of second openings.

18. A gas turbine engine in accordance with claim 15 wherein each said deflector is in flow communication with said combustor outer liner plurality of second openings.

19. A gas turbine engine in accordance with claim 15 wherein each said deflector is arcuate and extends radially outward from each said combustor outer liner first opening.

* * * * *